US005523274A

United States Patent [19]

Shuttleworth et al.

[11] Patent Number: 5,523,274

[45] Date of Patent: Jun. 4, 1996

[54] THERMAL DYE TRANSFER SYSTEM WITH LOW-TG POLYMERIC RECEIVER CONTAINING AN ACID MOIETY

[75] Inventors: Leslie Shuttleworth, Webster; Wayne A. Bowman, Walworth; Helmut Weber, Webster, all of N.Y.

[73] Assignee: Eastman Kodak Company, Rochester, N.Y.

[21] Appl. No.: 466,641

[22] Filed: Jun. 6, 1995

[51] Int. Cl.[6] ..... B41M 5/035; B41M 5/38

[52] U.S. Cl. ..... 503/227; 428/195; 428/913; 428/914

[58] Field of Search ..... 8/471; 428/195, 428/500, 913, 914; 503/227

[56] References Cited

U.S. PATENT DOCUMENTS 4,880,769 11/1989 Dix et al. ..... 503/227
5,030,612 7/1991 Uytterhoeven et al. ..... 503/227
5,324,705 6/1994 Ito ..... 503/227

*Primary Examiner*—B. Hamilton Hess
*Attorney, Agent, or Firm*—Harold E. Cole

[57] ABSTRACT

A thermal dye transfer assemblage comprising:

(a) a dye-donor element comprising a support having thereon a dye layer comprising a dye dispersed in a polymeric binder, the dye being a deprotonated cationic dye which is capable of being reprotonated to a cationic dye having a N—H group which is part of a conjugated system, and (b) a dye-receiving element comprising a support having thereon a polymeric dye image-receiving layer, the dye-receiving element being in a superposed relationship with the dye-donor element so that the dye layer is in contact with the polymeric dye image-receiving layer, the polymeric dye image-receiving layer containing an organic acid moiety as part of the polymer chain which is capable of reprotonating the deprotonated cationic dye, the polymeric dye image-receiving layer having a Tg of less than about 25° C.

8 Claims, No Drawings

THERMAL DYE TRANSFER SYSTEM WITH LOW-TG POLYMERIC RECEIVER CONTAINING AN ACID MOIETY

This invention relates to a thermal dye transfer receiver element of a thermal dye transfer system and, more particularly, to a polymeric dye image-receiving layer containing an organic acid moiety capable of reprotonating a deprotonated cationic dye transferred to the receiver from a suitable donor, the polymeric dye image-receiving layer having a Tg of less than about 25° C.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dyes for thermal dye transfer imaging should have bright hue, good solubility in coating solvents, good transfer efficiency and good light stability. A dye receiver polymer should have good affinity for the dye and provide a stable (to heat and light) environment for the dye after transfer. In particular, the transferred dye image should be resistant to damage caused by handling, or contact with chemicals or other surfaces such as the back of other thermal prints, adhesive tape, and plastic folders such as poly(vinyl chloride), generally referred to as "retransfer".

Commonly-used dyes are nonionic in character because of the easy thermal transfer achievable with this type of compound. The dye-receiver layer usually comprises an organic polymer with polar groups to act as a mordant for the dyes transferred to it. A disadvantage of such a system is that since the dyes are designed to be mobile within the receiver polymer matrix, the prints generated can suffer from dye migration over time.

A number of attempts have been made to overcome the dye migration problem which usually involves creating some kind of bond between the transferred dye and the polymer of the dye image-receiving layer. One such approach involves the transfer of a cationic dye to an anionic dye-receiving layer, thereby forming an electrostatic bond between the two. However, this technique involves the transfer of a cationic species which, in general, is less efficient than the transfer of a nonionic species.

U.S. Pat. No. 4,880,769 describes the thermal transfer of a neutral, deprotonated form of a cationic dye to a receiver element. The receiver element is described as being a coated paper, in particular organic or inorganic materials having an "acid-modified coating". The inorganic materials described are materials such as an acidic clay-coated paper. The organic materials described are "acid-modified polyacrylonitrile, condensation products based on phenol/formaldehyde, certain salicylic acid derivatives and acid-modified polyesters, the latter being preferred." However, the way in which the "acid-modified polyester" is obtained is that an image is transferred to a polyester-coated paper, and then the paper is treated with acidic vapor to reprotonate the dye on the paper.

There is a problem with using this technique of treating polymeric-coated papers with acidic vapors in that this additional step is corrosive to the equipment employed and is a safety hazard to operators. There is also a problem with such a post treatment step to provide an acidic counterion for the cationic dye in that the dye/counterion complex is mobile, and can be retransferred to unwanted surfaces.

U.S. Pat. No. 5,324,705 relates to the use of acidic resin receivers such as vinylidene chloride/acrylonitrile copolymers for use with modified cationic dyes where the counterion has been exchanged for a more oleophilic anion. There is no disclosure in this patent that these receivers can be used with a deprotonated cationic dye which is capable of being reprotonated to a cationic dye.

U.S. Pat. No. 5,030,612 discloses the thermal transfer of sublimable basic dye precursors into acid-containing acrylate copolymer receivers having a Tg between 30° and 90° C. Basic dye precursors are leuco type dyes and the acid groups in the receiver serve as color developing sites. Again there is no disclosure in this patent that these receivers can be used with a deprotonated cationic dye which is capable of being reprotonated to a cationic dye.

It is an object of this invention to provide a thermal dye transfer system employing a dye-receiver having an acidic dye image-receiving layer without having to use a post-treatment fuming step with acidic vapors. It is another object of this invention to provide a thermal dye transfer system employing a dye-receiver having an acidic dye image-receiving layer which upon transfer of the dye forms a dye/counterion complex which is substantially immobile, which would reduce the tendency to retransfer to unwanted surfaces.

This and other objects are achieved in accordance with this invention which relates to a thermal dye transfer assemblage comprising:

(a) a dye-donor element comprising a support having thereon a dye layer comprising a dye dispersed in a polymeric binder, the dye being a deprotonated cationic dye which is capable of being reprotonated to a cationic dye having a N—H group which is part of a conjugated system, and (b) a dye-receiving element comprising a support having thereon a polymeric dye image-receiving layer, the dye-receiving element being in a superposed relationship with the dye-donor element so that the dye layer is in contact with the polymeric dye image-receiving layer, the polymeric dye image-receiving layer containing an organic acid moiety as part of the polymer chain which is capable of reprotonating the deprotonated cationic dye, the polymeric dye image-receiving layer having a Tg of less than about 25° C.

The polymeric dye image-receiving layer contains an organic acid, such as a carboxylic, sulfonic, phosphonic or phenolic acid as part of the polymer chain. The polymeric dye image-receiving layer acts as a matrix for the deprotonated dye and the acid functionality within the dye image-receiving layer will concurrently cause reprotonation and regeneration of the parent cationic dye without the need of any additional process step. It was found that when the dye-receiving polymers according to the invention were used, retransfer of the transferred image to an adjacent material is much improved over the prior art receivers using higher Tg acrylic polymers.

In a preferred embodiment of the invention, the deprotonated cationic dye employed which is capable of being reprotonated to a cationic dye having a N—H group which is part of a conjugated system has the following equilibrium structure:

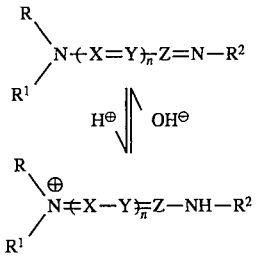

wherein:

X, Y and Z form a conjugated link between nitrogen atoms selected from CH, C-alkyl, N, or a combination thereof, the conjugated link optionally forming part of an aromatic or heterocyclic ring;

R represents a substituted or unsubstituted alkyl group from about 1 to about 10 carbon atoms;

$R^1$ and $R^2$ each individually represents substituted or unsubstituted phenyl or naphthyl or a substituted or unsubstituted alkyl group from about 1 to about 10 carbon atoms; and n is 0 to 11.

Cationic dyes according to the above formula are disclosed in U.S. Pat. Nos. 4,880,769 and 4,137,042, and in K. Venkataraman ed., *The Chemistry of Synthetic Dyes,* Vol. IV, p. 161, Academic Press, 1971, the disclosures of which are hereby incorporated by reference.

Any type of polymer may be employed in the receiver e.g., condensation polymers such as polyesters, polyurethanes, polycarbonates, etc.; addition polymers such as polystyrenes, vinyl polymers, etc.; block copolymers containing large segments of more than one type of polymer covalently linked together; provided such polymeric material contains acid groups as part of the polymer chain and has the low Tg as described above. In a preferred embodiment of the invention, the dye image-receiving layer comprises an acrylic polymer, a styrene polymer or a phenolic resin.

The following dyes may be used in accordance with the invention, which also have listed the absorption maxima of the deprotonated and protonated species, with the values for the latter shown in parentheses:

Dye 1

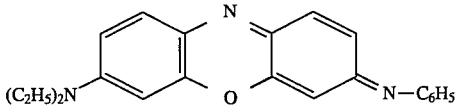

λmax 556nm (641nm)
magenta (cyan)

-continued

Dye 2

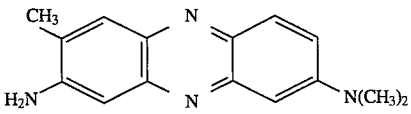

λmax 459nm (536nm)
yellow (magenta)

Dye 3

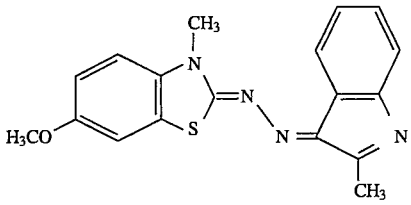

λmax 459nm (522nm)
yellow (magenta)

Dye 4

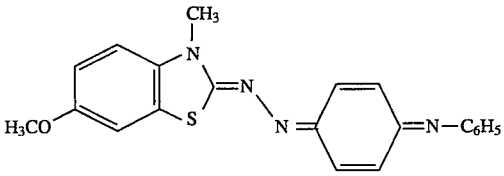

λmax 503nm (621nm)
red (blue)

Dye 5

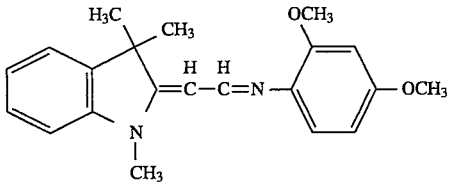

λmax 379nm (405nm)
yellow (yellow)

Dye 6

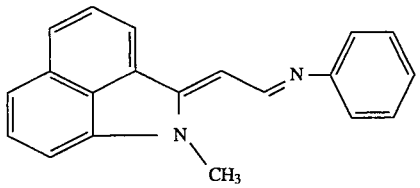

λmax 479nm (513nm)
yellow (magenta)

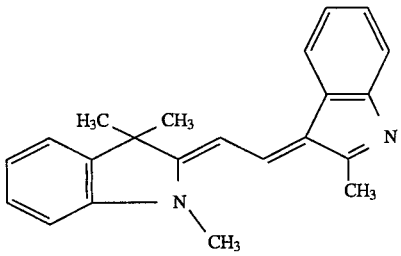

λmax 485nm (495)
yellow (yellow)

The following receiver polymers may be used in accordance with the invention:

Receiver 1 Poly(methyl acrylate-co-2-sulfoethyl methacrylate) 75/25 wt. %.

Receiver 2 Poly(butyl acrylate-co-2-acrylamido-2 -methyl-propanesulfonic acid-co-2 -hydroxyethyl methacrylate-co-methyl-2 -acrylamido-2-methoxyacetate) 70/10/10/10 wt. %.

Receiver 3 Poly(butyl acrylate-co-2-sulfoethyl methacrylate-co-methyl-2-acrylamido-2 -methoxyacetate) 65/25/10 wt. %.

Receiver 4 Poly(butyl acrylate-co-2-acrylamido-2 -methyl-propanesulfonic acid) 75/25 wt. %.

Receiver 5 Poly-2-ethylhexyl acrylate-co-2 -sulfoethyl-methacrylate-co-methyl-2 -acrylamido-2-methoxyacetate 65/25/10 wt. %.

Receiver 6 Poly(lauryl methacrylate-co-2-sulfoethyl methacrylate-co-methyl-2-acrylamido-2 -methoxyacetate) 70/25/5 wt. %.

The polymer in the dye image-receiving layer may be present in any amount which is effective for its intended purpose. In general, good results have been obtained at a concentration of from about 0.5 to about 10 g/m$^2$. The polymers may be coated from organic solvents or water, if desired.

The support for the dye-receiving element employed in the invention may be transparent or reflective, and may comprise a polymeric, a synthetic paper, or a cellulosic paper support, or laminates thereof. Examples of transparent supports include films of poly(ether sulfone)s, poly(ethylene naphthalate), polyimides, cellulose esters such as cellulose acetate, poly(vinyl alcohol-co-acetal)s, and poly(ethylene terephthalate). The support may be employed at any desired thickness, usually from about 10 μm to 1000 μm. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965,241, the disclosures of which are incorporated by reference. The receiver element may also include a backing layer such as those disclosed in U.S. Pat. Nos. 5,011,814 and 5,096,875, the disclosures of which are incorporated by reference. In a preferred embodiment of the invention, the support comprises a microvoided thermoplastic core layer coated with thermoplastic surface layers as described in U.S. Pat. No. 5,244,861, the disclosure of which is hereby incorporated by reference.

Resistance to sticking during thermal printing may be enhanced by the addition of release agents to the dye-receiving layer or to an overcoat layer, such as silicone-based compounds, as is conventional in the art.

Dye-donor elements that are used with the dye-receiving element of the invention conventionally comprise a support having thereon a dye layer containing the dyes as described above dispersed in a polymeric binder such as a cellulose derivative, e.g., cellulose acetate hydrogen phthalate, cellulose acetate, cellulose acetate propionate, cellulose acetate butyrate, cellulose triacetate, or any of the materials described in U.S. Pat. No. 4,700,207; or a poly(vinyl acetal) such as poly(vinyl alcohol-co-butyral). The binder may be used at a coverage of from about 0.1 to about 5 g/m$^2$.

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of deprotonated dyes, as described above, capable of generating a cyan, magenta and yellow dye and the dye transfer steps are sequentially performed for each color to obtain a three-color dye transfer image. Of course, when the process is only performed for a single color, then a monochrome dye transfer image is obtained.

Thermal print heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

When a three-color image is to be obtained, the assemblage described above is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner. After thermal dye transfer, the dye image-receiving layer contains a thermally-transferred dye image.

The following examples are provided to further illustrate the invention.

Example 1 —Preparation of Receiver 4 —Poly(butyl acrylate-co-2-acrylamido-2-methylpropanesulfonic acid) 75/25 wt. %.

To a 1-L three-necked flask equipped with a stirrer and condenser were added 400 g of degassed methanol, 75 g of butyl acrylate, 25 g of 2-acrylamido- 2-methyl-propanesulfonic acid and 0.50 g of 2,2'-azobis(methylpropionitrile). The solution was placed in a 60° C. bath and stirred under nitrogen for 16 hours to give a clear, viscous solution. The solution was cooled to 25° C. and contained 20% solids.

The other receivers according to the invention can be prepared in an analogous manner to the procedure described above.

Example 2

One set of dye-donor elements were prepared by coating on a 6 μm poly(ethylene terephthalate) support:

1) a subbing layer of Tyzor TBT®, a titanium tetrabutoxide, (DuPont Company) (0.16 g/m$^2$) coated from 1-butanol; and 2) a dye layer containing dyes 1, 6 and 7 described above in Butvar® 76 (a poly(vinyl butyral) binder from Monsanto Co.) coated from a tetrahydrofuran and cyclopentanone mixture (95/5) in the amounts shown in Table 1 below.

Another set of dye-donor elements were prepared by coating on a 6 μm poly(ethylene terephthalate) support:

1) a subbing layer of Tyzor TBT®, a titanium tetrabutoxide, (DuPont Company) (0.16 g/m$^2$) coated from 1-butanol; and 2) a dye layer containing dyes 1, 6 and 7 described above and FC-431® (0.01 g/m$^2$) in a cellulose acetate propionate binder (2.5% acetyl, 45% propionyl), coated from a tetrahydrofuran and cyclopentanone mixture (95/5) in the amounts shown in Table 1 below.

On the back side of the dye-donor element was coated:

1) a subbing layer of Tyzor TBT®, a titanium tetrabutoxide, (DuPont Company) (0.16 g/m$^2$) coated from 1-butanol; and 2) a slipping layer of Emralon 329® (Acheson Colloids Co.), a dry film lubricant of poly(tetrafluoroethylene) particles in a cellulose nitrate resin binder (0.54 g/m$^2$) and S-nauba micronized carnauba wax (0.016 g/m$^2$) coated from a n-propyl acetate, toluene, isopropyl alcohol and n-butyl alcohol solvent mixture.

TABLE 1

| Dye Donor Element | Dye | Dye Laydown g/m$^2$ | Butvar ® 76 Binder Laydown g/m$^2$ | Cellulose Binder Laydown g/m$^2$ |
|---|---|---|---|---|
| 1 | 1 | 0.15 | 0.23 | |
| 2 | 6 | 0.22 | 0.24 | |
| 3 | 7 | 0.23 | 0.30 | |
| 4 | 1 | 0.17 | | 0.17 |
| 5 | 6 | 0.22 | | 0.22 |
| 6 | 7 | 0.23 | | 0.23 |

Preparation and Evaluation of Dye-Receiver Elements

Dye-receiver elements according to the invention were prepared by first extrusion laminating a paper core with a 38 μ thick microvoided composite film (OPPalyte 350TW®, Mobil Chemical Co.) as disclosed in U.S. Pat. No. 5,244,861. The composite film side of the resulting laminate was then coated with the following layers in the order recited:

1) a subbing layer of Polymin Waterfree® polyethyleneimine (BASF, 0.02 g/m$^2$), and 2) a dye-receiving layer composed of the receiver polymers 1–6 described above and Control Polymers C-1 through C-5 described below (3.23 g/m$^2$), a fluorocarbon surfactant (Fluorad® FC- 170C, 3M Corporation, 0.022 g/m$^2$) [except for receiver polymers C-1 and C-2 which were coated using a polysiloxane-polyether wetting agent (Silwet® L-7602, Silwet Co., 0.16 g/m$^2$)] and a solvent as listed in Table 2 below. The following polymers are controls:

Polymer C 1:

Polystyrenesulfonic acid

Polymer C 2:

Poly(methyl methacrylate-co-2-sulfoethyl methacrylate) 75/25 wt. %.

Polymer C 3:

Poly(vinylidene chloride-co-acrylonitrile) 80/20 wt. %. (Aldrich Co.)

Polymer C 4:

Poly(butyl methacrylate-co-2-acrylamido-2-methylpropanesulfonic acid) 75/25 wt. %.

Polymer C 5:

Poly(butyl methacrylate-co-methacrylic acid-co-2 -acrylamido-2-methyl-propanesulfonic acid) 80.4/15.1/4.5 wt. %.

TABLE 2

| Polymer | Coating Solvent |
|---|---|
| 1 | tert-butanol |

TABLE 2-continued

| Polymer | Coating Solvent |
|---|---|
| 2 | methanol |
| 3 | methanol/methyl ethyl ketone (2:1) |
| 4 | methanol/methyl ethyl ketone (2:1) |
| 5 | methanol/methyl ethyl ketone (2:1) |
| 6 | methyl ethyl ketone |
| C-1 | methyl ethyl ketone |
| C-2 | tert-butanol |
| C-3 | methyl ethyl ketone |
| C-4 | methanol/methyl ethyl ketone (2:1) |
| C-5 | water |

Preparation and Evaluation of Thermal Dye Transfer Images

Eleven-step sensitometric thermal dye transfer images were prepared from the above dye-donor and dye-receiver elements. The dye side of the dye-donor element approximately 10 cm×15 cm in area was placed in contact with the dye image-receiving layer side of a dye-receiving element of the same area. This assemblage was clamped to a stepper motor-driven, 60 mm diameter rubber roller. A thermal head (TDK No. 8I0625, thermostatted at 31° C.) was pressed with a force of 24.4 newton (2.5 kg) against the dye-donor element side of the assemblage, pushing it against the rubber roller.

The imaging electronics were activated causing the donor-receiver assemblage to be drawn through the printing head/roller nip at 11.1 mm/s. Coincidentally, the resistive elements in the thermal print head were pulsed (128 μs/pulse) at 129 μs intervals during a 16.9 μs/dot printing cycle. A stepped image density was generated by incrementally increasing the number of pulses/dot from a minimum of 0 to a maximum of 127 pulses/dot. The voltage supplied to the thermal head was approximately 10.25 v resulting in an instantaneous peak power of 0.214 watts/dot and a maximum total energy of 3.48 mJ/dot.

After printing, the dye-donor element was separated from the imaged receiving element and the appropriate (red, green or blue) Status A reflection density of each of the eleven steps in the stepped-image was measured with a reflection densitometer.

The imaged side of the stepped image was placed in intimate contact with a similarly sized piece of a poly(vinyl chloride) (PVC) report cover, a 1 kg weight was placed on top and the whole assemblage was incubated in an oven held at 50° C. for 1 week. The PVC sheet was separated from the stepped image and the appropriate Status A transmission density in the PVC (a measure of the amount of dye transferred to the PVC) of the step corresponding to an initial Status A reflection density reading of 1.0, was measured with a transmission densitometer.

The results of these measurements are shown in Tables 3 to 5.

TABLE 3

| Status A Red Densities | | | | |
|---|---|---|---|---|
| Dye Donor Element | Dye Receiver Polymer | Tg of Polymer °C. | Initial Status A Reflection Density | PVC Transmission |
| 1 | 1 | 22 | 0.98 | 0.01 |

TABLE 3-continued

| Status A Red Densities | | | | |
|---|---|---|---|---|
| Dye Donor Element | Dye Receiver Polymer | Tg of Polymer °C. | Initial Status A Reflection Density | PVC Transmission |
| 1 | 2 | 14 | 0.99 | 0.01 |
| 1 | 3 | 6 | 0.95 | 0.01 |
| 1 | 4 | −1 | 1.07 | 0.01 |
| 1 | 5 | −17 | 1.19 | 0.01 |
| 1 | 6 | −32 | 1.03 | 0.01 |
| 1 | C-1 | 121 | 0.97 | 0.27 |
| 1 | C-2 | 73 | 1.10 | 0.25 |
| 1 | C-3 | 49 | 0.63 | 0.19 |
| 1 | C-4 | 44 | 1.03 | 0.04 |
| 4 | 1 | 22 | 0.88 | 0.01 |
| 4 | 4 | −1 | 1.10 | 0.01 |
| 4 | 6 | −32 | 0.96 | 0.01 |
| 4 | C-2 | 73 | 1.02 | 0.27 |
| 4 | C-5 | 51 | 1.01 | 0.11 |

TABLE 4

| Status A Green Densities | | | | |
|---|---|---|---|---|
| Dye Donor Element | Dye Receiver Polymer | Tg of Polymer °C. | Initial Status A Reflection Density | PVC Transmission |
| 2 | 1 | 22 | 1.05 | 0.00 |
| 2 | 2 | 14 | 1.15 | 0.01 |
| 2 | 3 | 6 | 1.06 | 0.01 |
| 2 | 4 | −1 | 1.16 | 0.01 |
| 2 | 5 | −17 | 1.09 | 0.01 |
| 2 | 6 | −32 | 0.87 | 0.01 |
| 2 | C-1 | 121 | 1.00 | 0.23 |
| 2 | C-2 | 73 | 1.05 | 0.05 |
| 2 | C-3 | 49 | 0.80 | 0.25 |
| 2 | C-4 | 44 | 0.95 | 0.02 |
| 5 | 1 | 22 | 1.07 | 0.00 |
| 5 | 4 | −1 | 1.08 | 0.00 |
| 5 | 6 | −32 | 1.15 | 0.01 |
| 5 | C-2 | 73 | 1.07 | 0.06 |
| 5 | C-5 | 51 | 1.06 | 0.13 |

TABLE 5

| Status A Blue Densities | | | | |
|---|---|---|---|---|
| Dye Donor Element | Dye Receiver Polymer | Tg of Polymer °C. | Initial Status A Reflection Density | PVC Transmission |
| 3 | 1 | 22 | 0.99 | 0.00 |
| 3 | 2 | 14 | 1.00 | 0.01 |
| 3 | 3 | 6 | 1.09 | 0.01 |
| 3 | 4 | −1 | 1.08 | 0.01 |
| 3 | 5 | −17 | 1.10 | 0.00 |
| 3 | 6 | −32 | 0.94 | 0.01 |
| 3 | C-1 | 121 | 0.70 | 0.04 |
| 3 | C-2 | 73 | 0.88 | 0.12 |
| 3 | C-3 | 49 | 0.91 | 0.05 |
| 3 | C-4 | 44 | 0.94 | 0.03 |
| 6 | 1 | 22 | 1.01 | 0.00 |
| 6 | 4 | −1 | 0.93 | 0.00 |
| 6 | 6 | −32 | 0.99 | 0.00 |
| 6 | C-2 | 73 | 0.98 | 0.08 |
| 6 | C-5 | 51 | 0.92 | 0.03 |

The results in Tables 3 to 5 clearly show that using acidic copolymer receivers with a Tg of less than 25° C. improves the PVC dye retransfer characteristics of images printed to these receivers as compared to images printed to acidic copolymer receivers with a Tg greater than 25° C.

The invention has been described in detail with particular reference to preferred embodiments thereof, but it will be understood that variations and modifications can be effected within the spirit and scope of the invention.

What is claimed is:

1. A thermal dye transfer assemblage comprising:

(a) a dye-donor element comprising a support having thereon a dye layer comprising a dye dispersed in a polymeric binder, said dye being a deprotonated cationic dye which is capable of being reprotonated to a cationic dye having a N—H group which is part of a conjugated system, and (b) a dye-receiving element comprising a support having thereon a polymeric dye image-receiving layer, said dye-receiving element being in a superposed relationship with said dye-donor element so that said dye layer is in contact with said polymeric dye image-receiving layer, said polymeric dye image-receiving layer containing an organic acid moiety as part of the polymer chain which is capable of reprotonating said deprotonated cationic dye, said polymeric dye image-receiving layer having a Tg of less than about 25° C.

2. The assemblage of claim 1 wherein said polymeric dye image-receiving layer comprises an acrylic polymer, a styrene polymer or a phenolic resin.

3. The assemblage of claim 1 wherein said organic acid comprises a carboxylic, sulfonic, phosphonic or phenolic acid.

4. The assemblage of claim 1 wherein said deprotonated cationic dye has the following formula:

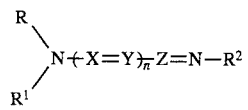

wherein:

X, Y and Z form a conjugated link between nitrogen atoms selected from CH, C-alkyl, N, or a combination thereof, the conjugated link optionally forming part of an aromatic or heterocyclic ring;

R represents a substituted or unsubstituted alkyl group from about 1 to about 10 carbon atoms;

$R^1$ and $R^2$ each individually represents substituted or unsubstituted phenyl or naphthyl or a substituted or unsubstituted alkyl group from about 1 to about 10 carbon atoms; and n is 0 to 11.

5. A process of forming a dye transfer image comprising imagewise-heating a dye-donor element comprising a support having thereon a dye layer comprising a dye dispersed in a polymeric binder, said dye being a deprotonated cationic dye which is capable of being reprotonated to a cationic dye having a N—H group which is part of a conjugated system, and imagewise transferring said dye to a dye-receiving element to form said dye transfer image, said dye-receiving element comprising a support having thereon a polymeric dye image-receiving layer, said polymeric dye image-receiving layer containing an organic acid moiety as part of the polymer chain which is capable of reprotonating said deprotonated cationic dye, said polymeric dye image-receiving layer having a Tg of less than about 25° C.

6. The process of claim 5 wherein said polymeric dye image-receiving layer comprises an acrylic polymer, a styrene polymer or a phenolic resin.

7. The process of claim 5 wherein said organic acid comprises a carboxylic, sulfonic, phosphonic or phenolic acid.

8. The process of claim 5 wherein said deprotonated cationic dye has the following formula:

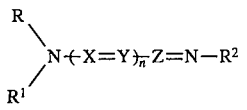

wherein:

X, Y and Z form a conjugated link between nitrogen atoms selected from CH, C-alkyl, N, or a combination thereof, the conjugated link optionally forming part of an aromatic or heterocyclic ring;

R represents a substituted or unsubstituted alkyl group from about 1 to about 10 carbon atoms;

$R^1$ and $R^2$ each individually represents substituted or unsubstituted phenyl or naphthyl or a substituted or unsubstituted alkyl group from about 1 to about 10 carbon atoms; and n is 0 to 11.

* * * * *